US010246917B2

(12) United States Patent
Ginter et al.

(10) Patent No.: US 10,246,917 B2
(45) Date of Patent: Apr. 2, 2019

(54) ADJUSTABLE HINGE TO ELIMINATE SHIMMING

(71) Applicant: BEST ACCESS SOLUTIONS, INC., Indianapolis, IN (US)

(72) Inventors: Mark Ginter, Noblesville, IN (US); Christine Cicchetti, Fishers, IN (US); Brandon Faulkner, Indianapolis, IN (US)

(73) Assignee: DORMAKABA USA INC., Indianapolis, IN (US)

( * ) Notice: Subject to any disclaimer, the term of this patent is extended or adjusted under 35 U.S.C. 154(b) by 267 days.

(21) Appl. No.: 15/087,260

(22) Filed: Mar. 31, 2016

(65) Prior Publication Data

US 2017/0081889 A1 Mar. 23, 2017

Related U.S. Application Data

(60) Provisional application No. 62/221,711, filed on Sep. 22, 2015.

(51) Int. Cl.

| | |
|---|---|
| ***E05D 7/04*** | (2006.01) |
| ***E05D 5/04*** | (2006.01) |
| ***E05D 3/08*** | (2006.01) |
| *E05D 3/02* | (2006.01) |

(52) U.S. Cl.

CPC ..... *E05D 7/0423* (2013.01); *E05D 3/08* (2013.01); *E05D 5/04* (2013.01); *E05D 3/02* (2013.01); *E05D 2007/0461* (2013.01)

(58) Field of Classification Search

CPC .... E05D 3/02; E05D 3/08; E05D 5/04; E05D 7/04; E05D 7/0415; E05D 7/0423

USPC ..... 16/235–236, 238, 242, 245, 247, 387

See application file for complete search history.

(56) References Cited

U.S. PATENT DOCUMENTS

| | | | | |
|---|---|---|---|---|
| 310,333 A | | 1/1885 | Terrell | |
| 1,002,394 A | | 9/1911 | Hanson | |
| 1,092,926 A | * | 4/1914 | Madsen | E05D 5/04 16/388 |
| 2,373,955 A | | 4/1945 | Fuller | |
| 2,744,284 A | | 4/1952 | McMillan | |

(Continued)

OTHER PUBLICATIONS

Patent Cooperation Treaty, International Search Report and Written Opinion of the International Searching Authority, PCT/US2016/053086, Stanley Security Solutions, Inc., dated Dec. 15, 2016, 9 pages.

(Continued)

*Primary Examiner* — Roberta S Delisle

(74) *Attorney, Agent, or Firm* — Faegre Baker Daniels LLP

(57) ABSTRACT

An adjustable hinge of the present invention includes a hinge pin and a hinge plate coupled to the hinge pin and a plurality of adjusters configured to threadedly engage a plurality of threaded apertures formed in the hinge plate. The adjusters define respective central pass-through bores for receiving a fastener configured to fasten the hinge plate to a door or door frame. The adjusters are operatively associated with a door or door frame, so that, after slightly loosening the existing fastener, rotating the adjuster changes the gap between the hinge plate and the surface of the door or door frame. Once the desired gap has been obtained, the fastener is tightened against the adjuster, and into the door or door frame, thereby maintaining the gap.

22 Claims, 15 Drawing Sheets

(56) References Cited

U.S. PATENT DOCUMENTS

| | | | | | |
|---|---|---|---|---|---|
| 3,908,330 | A * | 9/1975 | Frach | E05D 5/0238 | 403/348 |
| 3,977,042 | A | 8/1976 | Lautenschlaeger | | |
| 4,156,301 | A | 5/1979 | Schneider et al. | | |
| 4,881,296 | A * | 11/1989 | Marinoni | E05D 5/0238 | 16/237 |
| 5,072,488 | A * | 12/1991 | Winyard | E05D 5/023 | 16/241 |
| 5,555,605 | A * | 9/1996 | Mosher | E05D 7/0423 | 16/238 |
| 6,049,946 | A | 4/2000 | Cress et al. | | |
| 6,058,564 | A | 5/2000 | Purcell et al. | | |
| 6,112,371 | A | 9/2000 | Tremblay | | |
| 6,820,308 | B1 * | 11/2004 | Crittenden | E06B 3/7001 | 16/387 |
| 7,350,272 | B2 | 4/2008 | Fries | | |
| 7,516,517 | B2 | 4/2009 | Fries | | |
| 7,617,567 | B2 * | 11/2009 | Franchini | E05D 7/04 | 16/236 |
| 7,694,388 | B2 | 4/2010 | Campbell et al. | | |
| 7,748,081 | B2 * | 7/2010 | Ganter | E05D 7/04 | 16/235 |
| 8,863,358 | B2 | 10/2014 | Ochs | | |
| 2013/0333160 | A1 | 12/2013 | Ochs | | |

OTHER PUBLICATIONS

Patent Cooperation Treaty, International Preliminary Report on Patentability, PCT/US2016/053086, Best Access Solutions Inc., dated Mar. 27, 2018, 9 pages.

* cited by examiner

ADJUSTABLE HINGE TO ELIMINATE SHIMMING

CROSS-REFERENCE TO RELATED APPLICATION

This is a non-provisional application based upon U.S. provisional patent application Ser. No. 62/221,711, entitled "ADJUSTABLE HINGE TO ELIMINATE SHIMMING", filed Sep. 22, 2015, from which priority is claimed, and which is incorporated herein by reference in its entirety.

BACKGROUND OF THE INVENTION

1. Field of the Invention

The present invention relates to hinges and door systems, and, more particularly, to adjustable hinges and door systems that use the same.

2. Description of the Related Art

During the lifetime of a dwelling or office, the walls and other parts of the structure tend to get out of alignment. This frequently results in the door latch of a door no longer lining up with the strike located on the door frame, so that the door no longer latches properly when it's closed. In order to realign the door latch with the door strike, it is necessary to make an adjustment at the door hinges. The problem is, a technician must remove the screws from a hinge on a door to make any adjustment. And usually this means that the technician must adjust more than just one hinge. In fact, multiple hinges on the door need to be brought into line. The adjustment is presently made by inserting shims between the hinge(s) and the door frame. This creates or changes a gap between the hinge and the door frame. Depending upon the location of a particular shim, the act of creating or changing the gap causes the door to be adjusted vertically, horizontally, and/or angularly, relative to the frame, and thus changes the orientation of the door latch to the door strike so that the door latches correctly. As may be imagined, by the time this procedure has been repeated for all of the hinges, it has become a tedious and time-consuming process, and consequently has entailed a considerable expense.

Attempts have been made to simplify this process. For example, U.S. Pat. No. 8,863,358 to Ochs discloses the use of lifting elements threadedly attached to a hinge plate via threaded holes formed in the hinge plate. As a particular lifting element is rotated in the hinge plate, such as, for example, by a screwdriver, the lifting element extends beyond the rear surface of the hinge plate to cause a separation between the hinge plate and the door jamb or frame. The difficulty is, that in order to use this system, the hinge plate must also be equipped with separate holes for receiving conventional screws of the type that are typically used for connecting the hinge plate to the door and frame. This causes the hinge plate to be peppered with holes and fasteners, and is unsightly when installed on a door and door frame. Furthermore, this system requires additional forming operations when manufacturing the hinge.

Accordingly, what is needed is a hinge that can be adjusted using a single set of apertures formed in the hinge plate, each aperture accommodating both an adjuster and the conventional fastener for connecting the hinge to the door or the door frame. The present invention provides such a solution.

SUMMARY OF THE INVENTION

The present invention provides a hinge having a hinge pin, a hinge plate coupled to the hinge pin, the hinge plate defining at least one threaded aperture, and an adjuster configured to threadedly engage each threaded aperture, such that the adjuster defines a central pass-through bore for receiving a fastener configured to fasten the hinge plate to a door or door frame, the adjusters being operatively associated with the surface of a frame or door to change the distance between the hinge plate and the surface of the frame or door.

In one embodiment of the adjustable hinge of the present invention, the adjustable hinge includes a frame hinge plate and a door hinge plate; the frame hinge plate defines a plurality of threaded apertures for threadedly receiving the adjusters, and is coupled to the door hinge plate via a hinge pin. The door hinge plate, on the other hand, includes a plurality of apertures configured to accept conventional fasteners for attaching the door hinge plate to a door.

In another embodiment of the adjustable hinge of the present invention, the door hinge plate includes a plurality of threaded apertures instead of the conventional apertures.

In still another embodiment of the present invention, the adjusters each include a shoulder formed on a front face of the adjuster to provide extra strength when the adjuster is threaded into a respective threaded aperture.

In yet another embodiment of the present invention, the hinge plate defines annular shoulders proximate the threaded apertures, the adjusters including first and second members threadedly attached to one another, so that they can be advanced or retracted in the hinge plate threaded aperture as a single unit or assembly. One of the first and second members is configured to engage the hinge plate shoulder to limit the amount of axial travel of the first and second members in the hinge plate threaded aperture.

In another embodiment of the present invention, an anti-rotation member is operatively associated with the first and second members to prevent relative rotation therebetween.

In still another embodiment of the present invention, the adjuster includes a tool-engaging feature configured for engagement by a tool for rotating the adjuster in its respective threaded aperture.

In a further embodiment of the present invention, the tool includes a cylindrical body configured to be slipped over the fastener, and into engagement with the adjuster tool-engaging feature.

In yet another embodiment of the present invention, the tool includes a handle portion connected to an annular portion which defines a central aperture, which is configured to slip over the fastener, and which further defines tangs for engagement with mating recesses formed in the adjuster.

In a further embodiment of the present invention, a door system includes a door pivotably connected to a door frame via a plurality of adjustable hinges according to the present invention, the hinges including first and second hinge plates coupled to a hinge pin, wherein at least one of the first and second hinge plates define a plurality of threaded apertures. A plurality of threaded adjusters are engaged with respective threaded apertures and are configured to selectively axially bear against a surface of the door or door frame to change the distance between the at least one of the first and second hinge plates and a surface of the door or door frame, the adjusters further defining respective central pass-through bores for receiving a fastener, the fastener being disposed in each pass-through bore and configured to fasten the hinge plate to the door or door frame.

Finally, in still another embodiment of the present invention, a method of changing the spacing between a hinge plate mounted on a door or door frame and the surface of the door or door frame includes loosening a fastener connecting the hinge plate to the door or door frame; then rotating an annular threaded adjuster disposed in a threaded aperture formed in the hinge plate about, and coaxial with, the fastener, so that the distance between a rear surface of the hinge plate and the surface of the door or frame changes; and then tightening the fastener.

The present invention accordingly yields an adjustable hinge which is inexpensive to manufacture, presents a much cleaner appearance when installed on a door or door frame, and provides considerably faster adjustment than is currently available in the art.

BRIEF DESCRIPTION OF THE DRAWINGS

The above-mentioned and other features and advantages of the present invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE INVENTION

Figure 1:
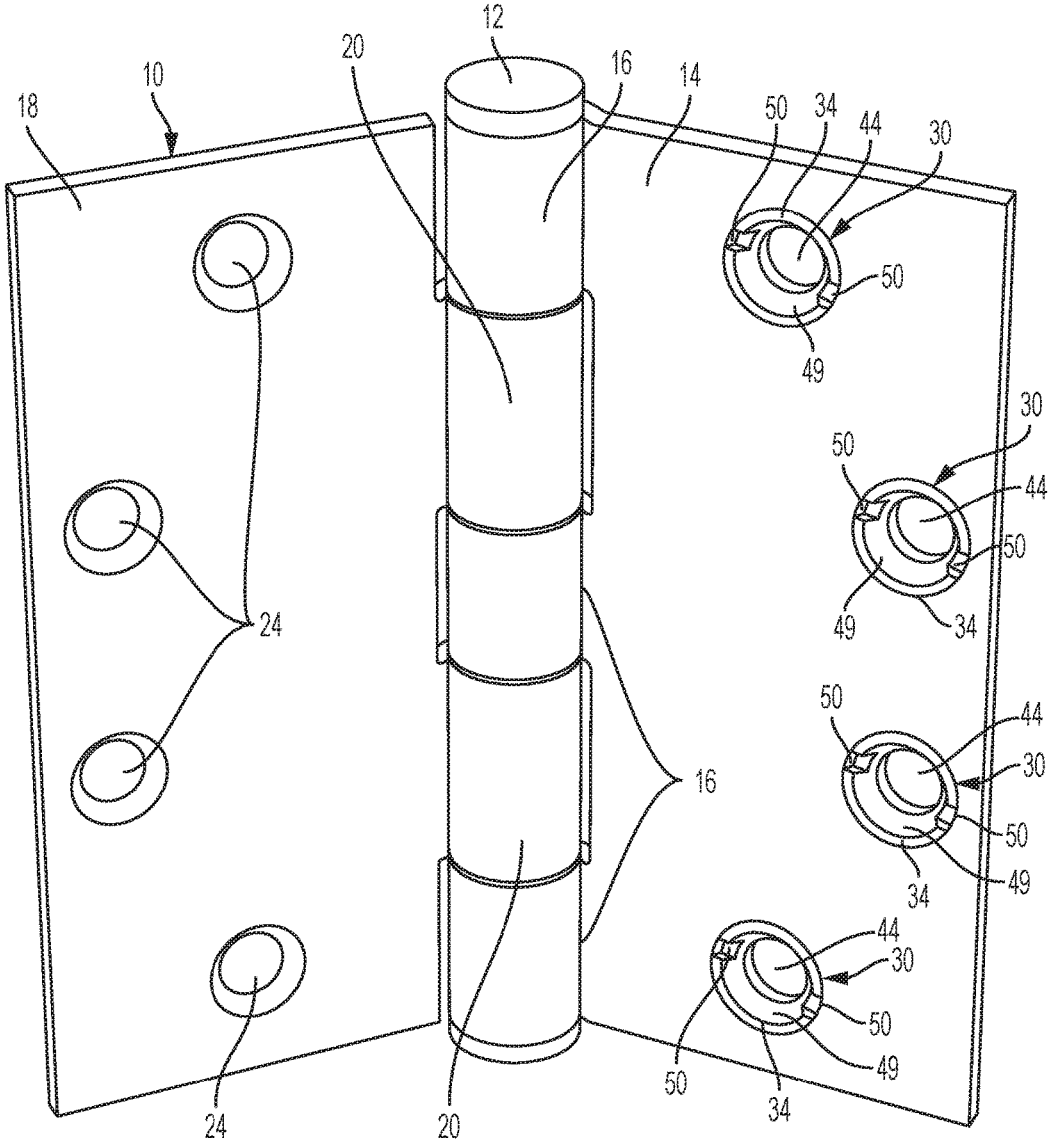
FIG. 1 is a front perspective view of one embodiment of an adjustable hinge according to the present invention.

Referring now to the drawings and particularly to FIGS. 1, 3 and 6A-6C, there is shown an adjustable hinge 10 in accordance with an embodiment of the present invention. The adjustable hinge 10 includes a hinge pin 12, a frame hinge plate 14 coupled to the hinge pin via frame hinge plate knuckles 16, and a door hinge plate 18 coupled to the hinge pin via door hinge plate knuckles 20. The frame hinge plate 14 defines a plurality of threaded apertures 22. In this embodiment of the adjustable hinge 10 of the present invention, four threaded apertures 22 are formed in the frame hinge plate 14; however, it can be appreciated that fewer or more than four threaded apertures may be used, depending upon the requirements of the particular application. The hinge plates 14, 18 may be formed of steel, which may be manufactured according to BHMA Standard A156.1, Section 3.8.

Figure 3:
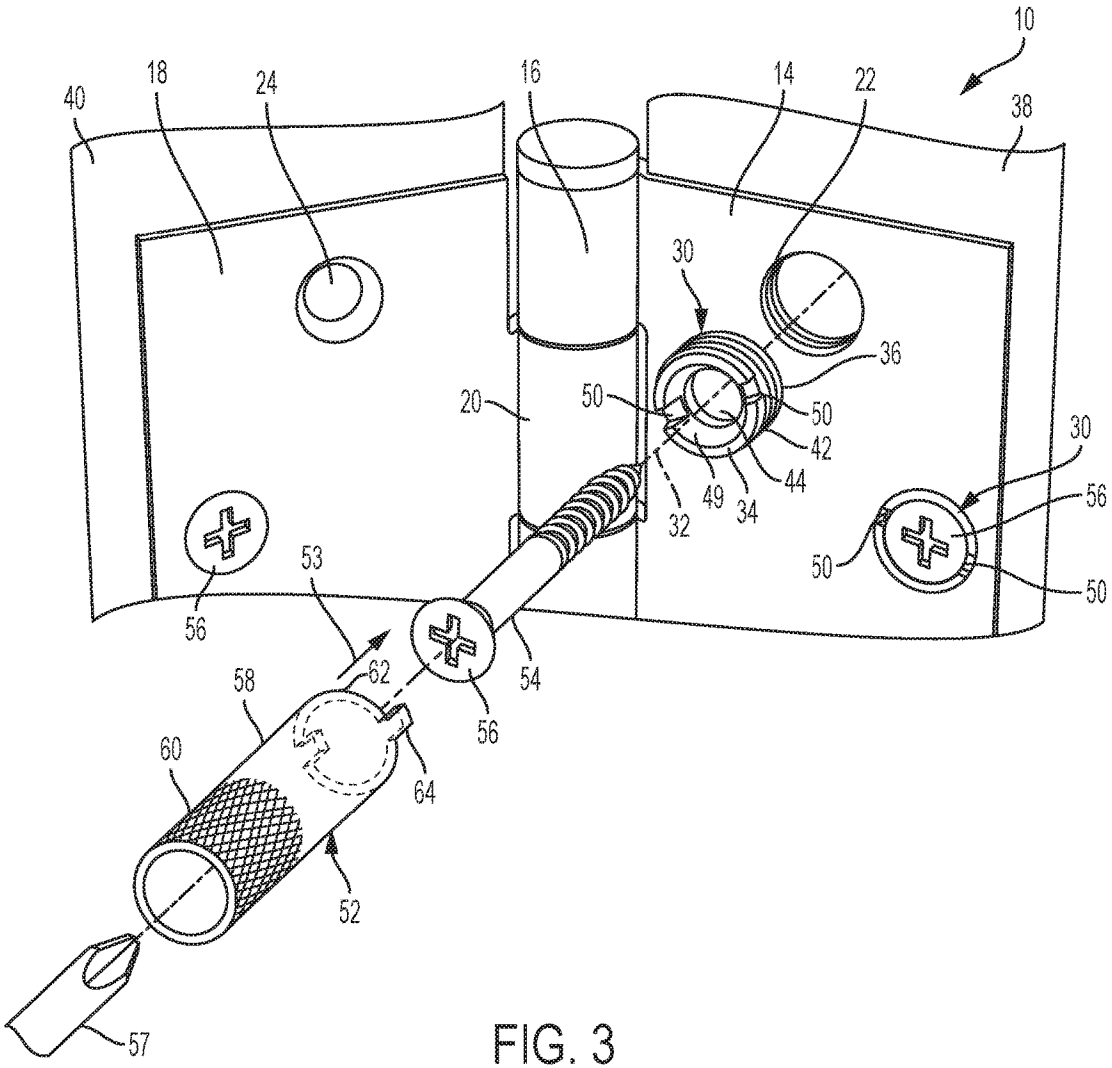
FIG. 3 is an enlarged perspective exploded detail view of the adjustable hinge of FIG. 1, illustrating a fastener driver coaxially aligned with a tool, a fastener, an adjuster, and a threaded aperture of a frame hinge plate, according to one embodiment of the present invention, the frame hinge plate being shown embedded in the surface of a door frame.
Figure 4:
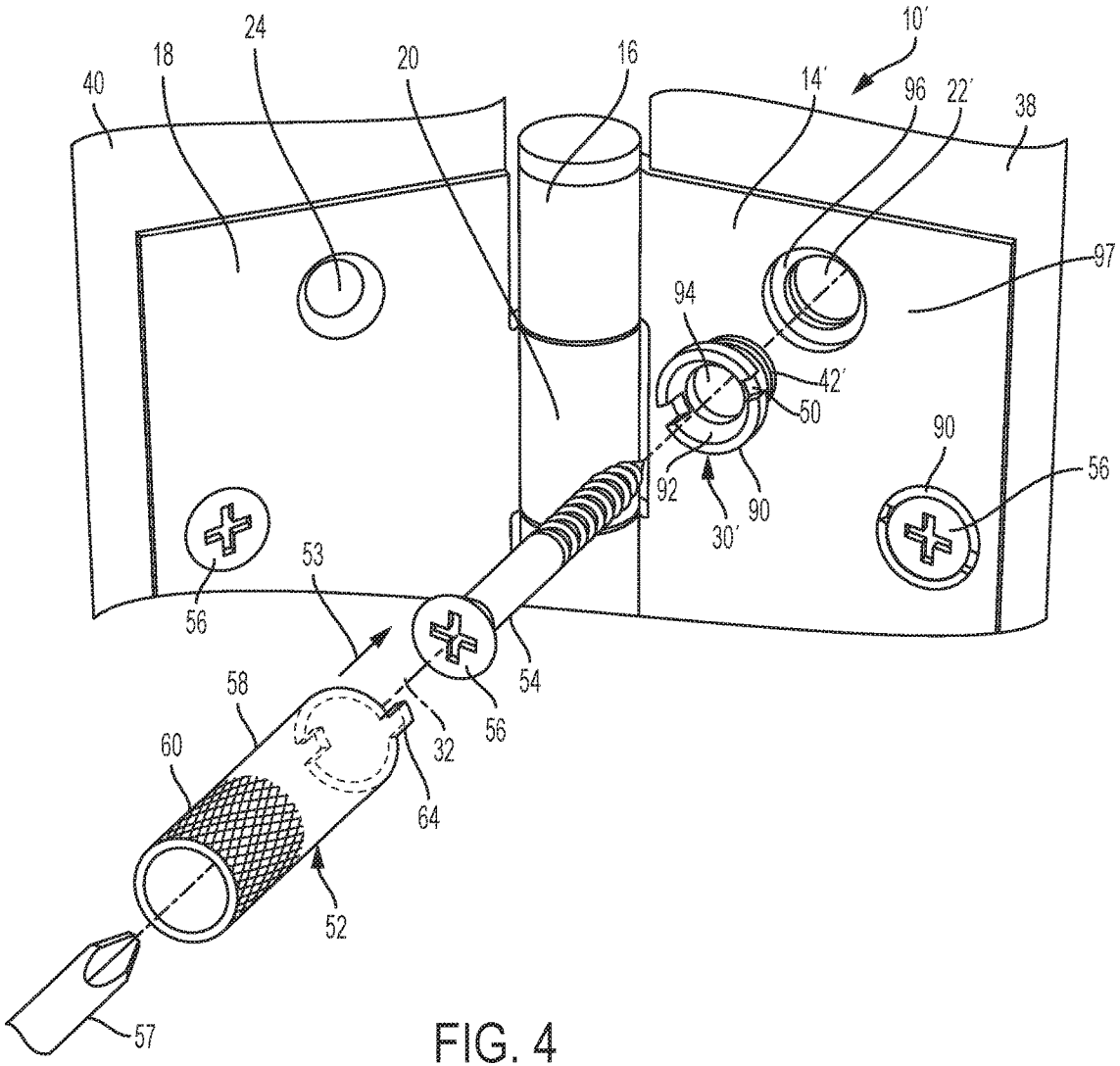
FIG. 4 is an enlarged perspective exploded detail view of an adjustable hinge, similar to that shown in FIG. 3, but illustrating the embodiment of the adjustable hinge shown in FIG. 2.

FIGS. 1 and 3 show that, on the other hand, the door hinge plate 18 of this embodiment of the adjustable hinge 10 of the present invention defines a plurality of conventionally-chamfered through-holes 24. Again, fewer or more than four through-holes 24 may be used, depending upon the requirements of the particular application.

Now referring to FIGS. 1, 3, 6A and 6B, the adjustable hinge 10 further includes an adjuster 30 configured to threadedly engage each threaded aperture 22. The adjuster 30 defines a longitudinal axis 32, and is formed as an annular body having an annular front face 34, and an annular rear face 36 engageable with a surface of a door frame 38 or a door 40. The front face 38 and the rear face 36 lie in respective planes substantially perpendicular to the longitudinal axis 32. The adjuster 30 further defines an outer annular surface 42 threaded to match the threads of the threaded aperture 22, and an unthreaded central pass-through bore 44. The pass-through bore 44 has a first diameter 46 proximate the front face 38 and a second diameter 48 proximate the rear face 36, the second diameter being smaller than the first diameter, such that the pass-through bore forms a truncated cone or chamfer 49. Furthermore, the adjuster 30 defines a tool-engaging feature 50 for engagement by a tool 52 for rotating the adjuster 30 in its respective threaded aperture 22. As may be imagined, the tool-engaging feature 50, and tool 52, may be any suitable combination which causes the adjuster 30 to be advanced or retracted within the threaded aperture 22. Preferably, as shown in FIG. 3, tool 52 is configured to be slipped over a conventional fastener 54, such as a screw having a chamfered fastener head 56 (a Phillips-head screw is illustrated, but may be any suitable fastener for attaching the adjustable hinge 10 of the present invention to a door frame 38 or door 40), and into engagement with the tool-engaging feature 50 (arrow 53). This enables a fastener driver 57 to engage the fastener head 56, and rotate the fastener 54 in the door frame 38 and into or out of engagement with the chamfer 49 of adjuster 30 without disturbing the position of the adjuster 30. According to an embodiment of the adjustable hinge 10 of the present invention, the tool-engaging feature 50 is defined by radially-opposed axial slots formed in the front face 34 of the adjuster 30.

Still referring to FIGS. 1, 3 and 6A and 6B, for the example of an adjustable hinge 10 of the present invention described above, the adjuster 30 may be formed of stainless steel or high-strength carbon steel, or any other high-strength material suitable for bearing the loads and resisting the stresses associated with steel door hinges pivotably connecting doors to door frames. It may have an outer diameter of 0.500", an inner diameter of 0.325" and define a chamfer 49 of 82°. The threads formed on the outer annular surface 42 may be ½-20, corresponding to the ½-20 threaded apertures 22 in the frame hinge plate 14. The slots 50 may be 0.125" wide and have an axial depth of 0.065". Furthermore, the adjuster 30 may have a height of 0.190". Of course it should be understood that these dimensions are purely illustrative; the adjuster 30 may be configured in any way desired for a particular application of the adjustable hinge 10 of the present invention. Next, various embodiments of the tool 52 of the present invention will be described.

As shown in FIG. 3 and FIGS. 12A-12D, one embodiment of a tool 52 for the adjustable hinge 10 of the present invention includes a cylindrical body defining a longitudinal axis 32 having an annular exterior surface 58 including a knurled portion 60 for gripping by the fingers of a person's hand, or by a wrench. The tool 52 also defines an axial end 62. Two radially-opposed tangs 64 extend axially away from the end 62, and are configured to engage the slots 50 formed in the front faces 34 of the adjusters 30, as is illustrated in FIG. 3. This tool 52 may be formed out of steel tubing, but it will be understood that the tool may also be formed of any material suitable for holding the adjuster 30 in place while a driver 57 advances or retracts the fastener 54 within the adjuster 30 and door frame 38. Tool 52 is designed to be reusable, and therefore included in the tools carried in the technician's toolbox. Referring to FIGS. 12A-12D, for the example of an adjustable hinge of the present invention described above, the tool 52 may be formed of 0.049" wall steel tubing having an outer diameter of 0.500". It may further have a length of 1.650", with the knurled portion 60 being 0.900" long. The tangs 64 may have the same thickness as the steel tubing, and may be 0.110" wide and extend axially 0.060" from the end 62 of the tool 52. Of course it should be understood that these dimensions are purely illustrative; the tool 52 may be configured in any way desired for a particular application to various embodiments of the adjustable hinge of the present invention.

Another embodiment of a tool 52' for the adjustable hinge 10 of the present invention is illustrated in FIGS. 13A-13D, and is in the form of a flat wrench 66 including a handle portion 68 connected to an annular portion 70. Preferably, the handle portion 68 defines a knurled portion 72, which may be created by a series of shallow parallel slots, and is oriented at an angle 74 to the annular portion 70. The annular portion defines an annular aperture 76, which further defines two radially-opposed, downwardly-extending tangs 78 configured for engagement with the slots 50 of the adjuster 30. If desired, this embodiment of tool 52' may be inexpensively formed of a suitable plastic, including without limitation high-strength ABS or polycarbonate, so that it may be included in the package containing the components of the adjustable hinge 10 of the present invention, and then either retained or recycled. On the other hand, if desired, the flat wrench 66 may be formed of 0.074" cold rolled steel. Still referring to FIGS. 13A-13D, for the example of an adjustable hinge of the present invention described above, the tool 52' handle portion 68 may be 0.400" wide and 0.788" long and extend from the annular portion 70 at an angle 74 of 10°. The annular portion 70 may have an outer diameter of 1.000" and define an annular aperture 76 having a diameter of 0.562". The tangs 78 may be 0.100" wide and extend downwardly from an upper surface of the annular portion for distance of 0.130". The tangs 78 may have approximately the same thickness as the material from which the flat wrench 66 is formed. Of course it should be understood that these dimensions are also purely illustrative; the tool 52' may be configured in any way desired for a particular application to various embodiments of the adjustable hinge of the present invention. Next will be described a method for using the tools 52, 52' in conjunction with the adjustable hinge 10 of the present invention.

FIGS. 5A-5D, in conjunction with FIG. 3, illustrate a method according to an embodiment of the present invention for using the adjustable hinge 10 of the present invention to adjust the spacing between a door frame hinge plate 14 and a surface of the door frame 38. Note that the adjustable hinge 10 of the present invention may also be used to adjust the spacing between a door hinge plate 18, and a surface of a door 40, using the same method. Furthermore, the method shown in FIGS. 3 and 5A-5D is also applicable to various alternative embodiments of the adjuster 30 of the present invention, as will be described below.

Figure 5A:
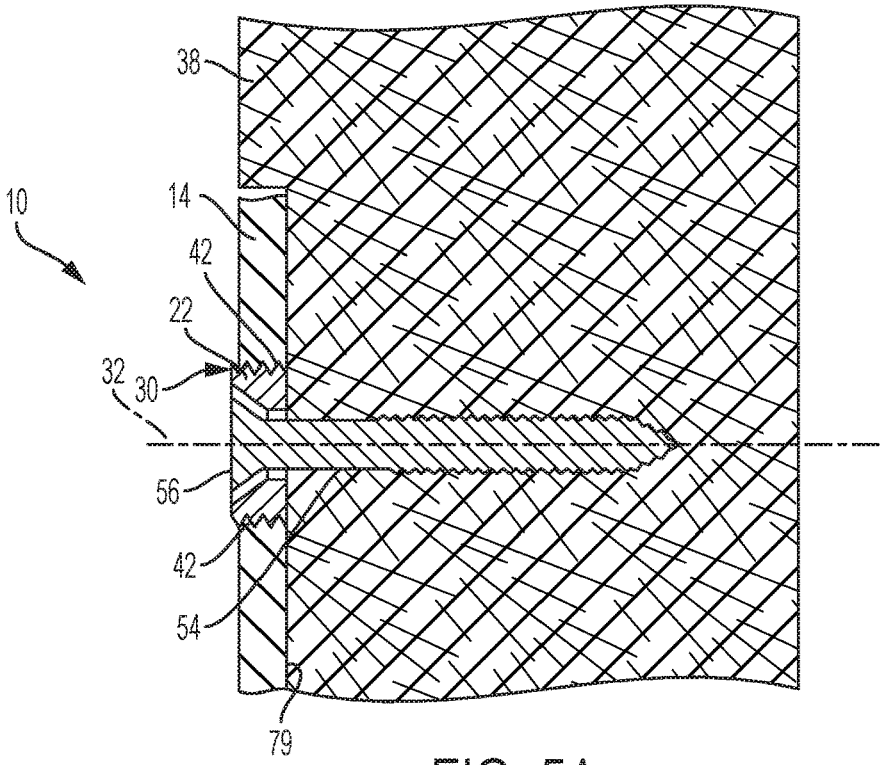
FIGS. 5A-5D are enlarged sequential schematic sectional detail views of the adjustable hinge of FIG. 1, shown attached to a door frame, and illustrating a method according to the present invention for adjusting a gap between the frame hinge plate of the present invention and a surface of the frame.
Figure 5B:
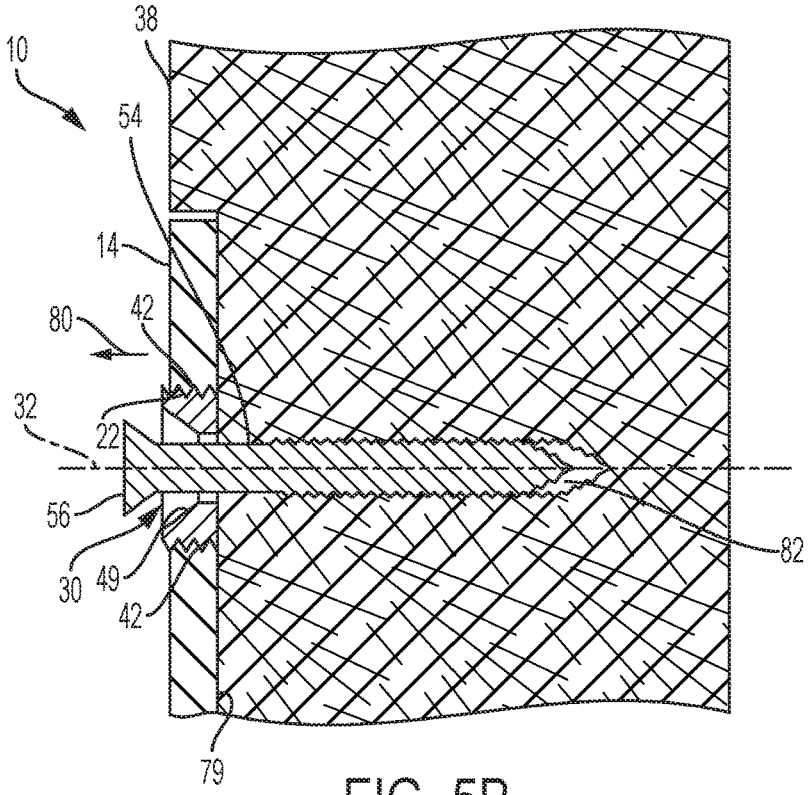

First, as shown in FIGS. 3 and 5A, a tool 52 is axially aligned with adjuster 30 so that its tangs 64 engage the slots 50 formed in the adjuster, and so that the adjuster is held in place. For best results, at this stage, the rear faces 36 of the adjusters 30 should not protrude from a rear face 79 of the door frame hinge plate 14. Then, as shown in FIGS. 3 and 5B, the driver 57 is inserted into the tool 52, such that the driver drivingly engages the head 56 of fastener 54. The fastener 54 is then slightly loosened or backed out as shown by arrow 80, creating a small space 82 within the door frame 38. It should be noted that, although tool 52 is illustrated as being used in this method of the present invention, the embodiment of the flat wrench 66 (tool 52') of the present invention shown in FIGS. 13A-13D may also be used, whereby the flat wrench annular aperture 76 is placed upon the adjuster 30 so that the downwardly-extending tangs 78 engage the grooves 50 in the adjuster. Then the driver 57 may be inserted through the annular aperture 76 of the flat wrench 66 to drivingly engage the fastener head 56, as set forth above.

Figure 5C:
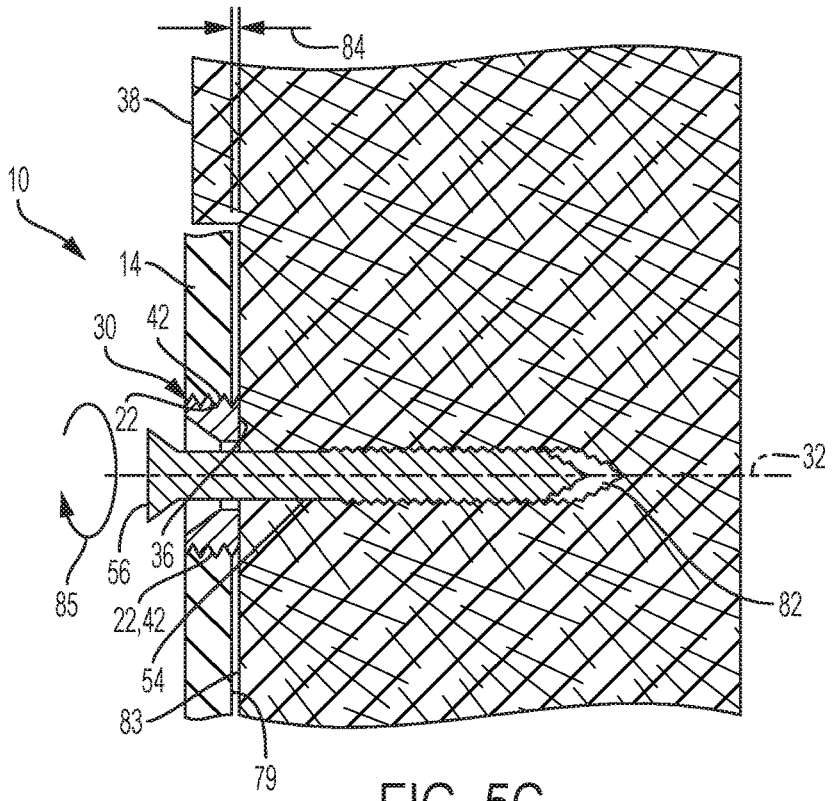

Next, as shown in FIGS. 3 and 5C, the tool 52 is rotated (arrow 85) to advance the adjuster 30 in the threaded aperture 22 so that its rear face 36 engages a surface 83 of the door frame 38. The adjuster 30 is advanced (or retracted) to create the desired gap 84 between the frame hinge plate 14 and the surface 83 of the door frame 38. For best results, the maximum extent that the adjuster 30 should protrude from the rear surface 79 of the frame hinge plate, and therefore, the maximum gap 84 created thereby, should be no greater than 0.063", which is the equivalent thickness of three standard hinge shims.

Figure 5D:
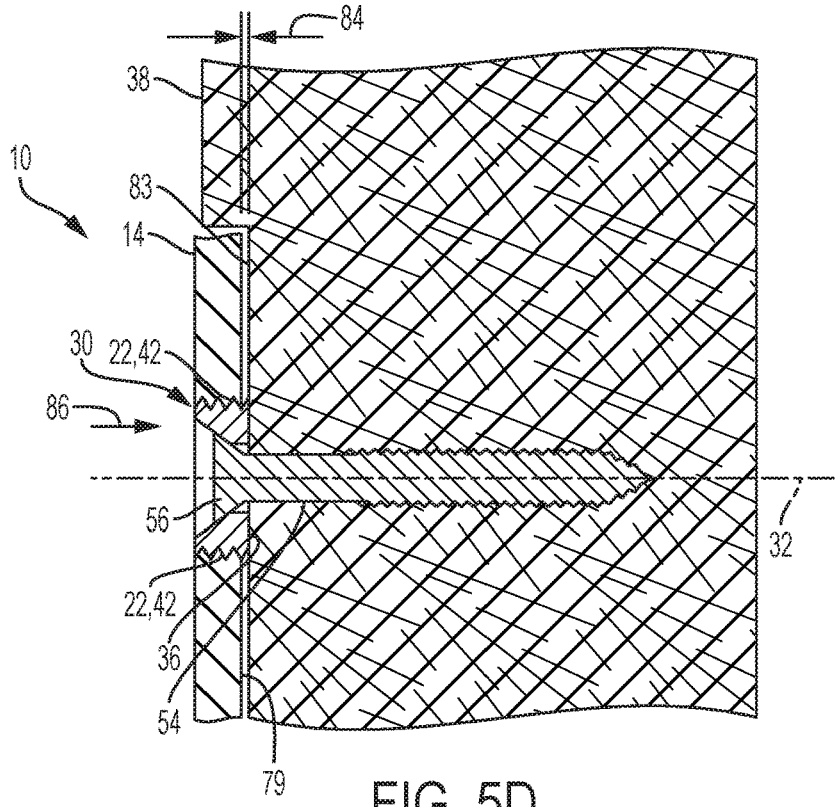
Figure 6A:
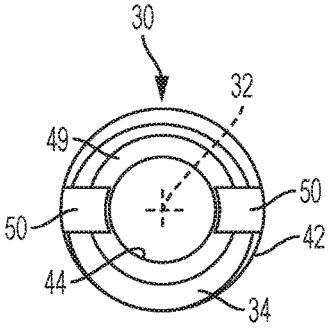
FIGS. 6A and 6B are top plan and side elevational detail views, respectively, of an adjuster of the adjustable hinge of FIG. 1.
Figure 6B:
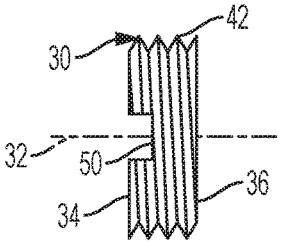
Figure 6C:
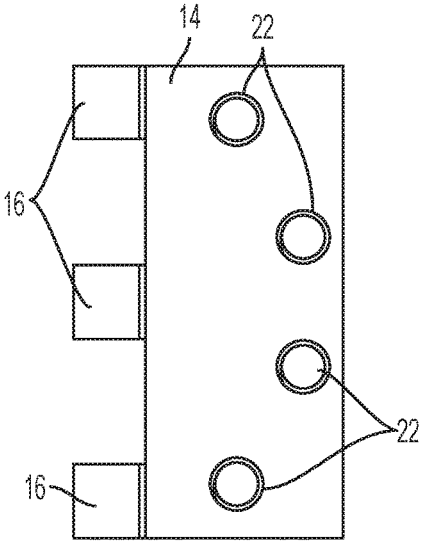
FIG. 6C is a top plan detail view of a frame hinge plate of the adjustable hinge of FIG. 1.

Finally, as shown in FIGS. 3 and 5D, while the adjuster 30 is still held in place by tool 52, the driver 57 is rotated in the opposite direction to return the fastener 54 to its original position in the frame 38 (arrow 86), thereby tightening the fastener against the adjuster and locking it in place so that the gap 84 is maintained.

The method of the present invention for adjusting the gap 84, as set forth, above may also be used when adjusting the gap 84 to be smaller. Accordingly, it can be recognized that by using the process according to the present invention described above, the cumulative time saved per door, compared to conventional shimming techniques where the hinges must actually be totally removed from the door frame, followed by inserting one or more shims by trial and error, can be considerable, inasmuch as several such adjustments may be required to be made for each hinge of a door and door frame.

Having thus described the structure and operation of one embodiment of the adjustable hinge 10 of the present invention, additional embodiments will now be described. The method according to the present invention for adjusting the gap 84, as described above, is equally applicable to such additional embodiments of the adjustable hinge of the present invention.

Figure 2:
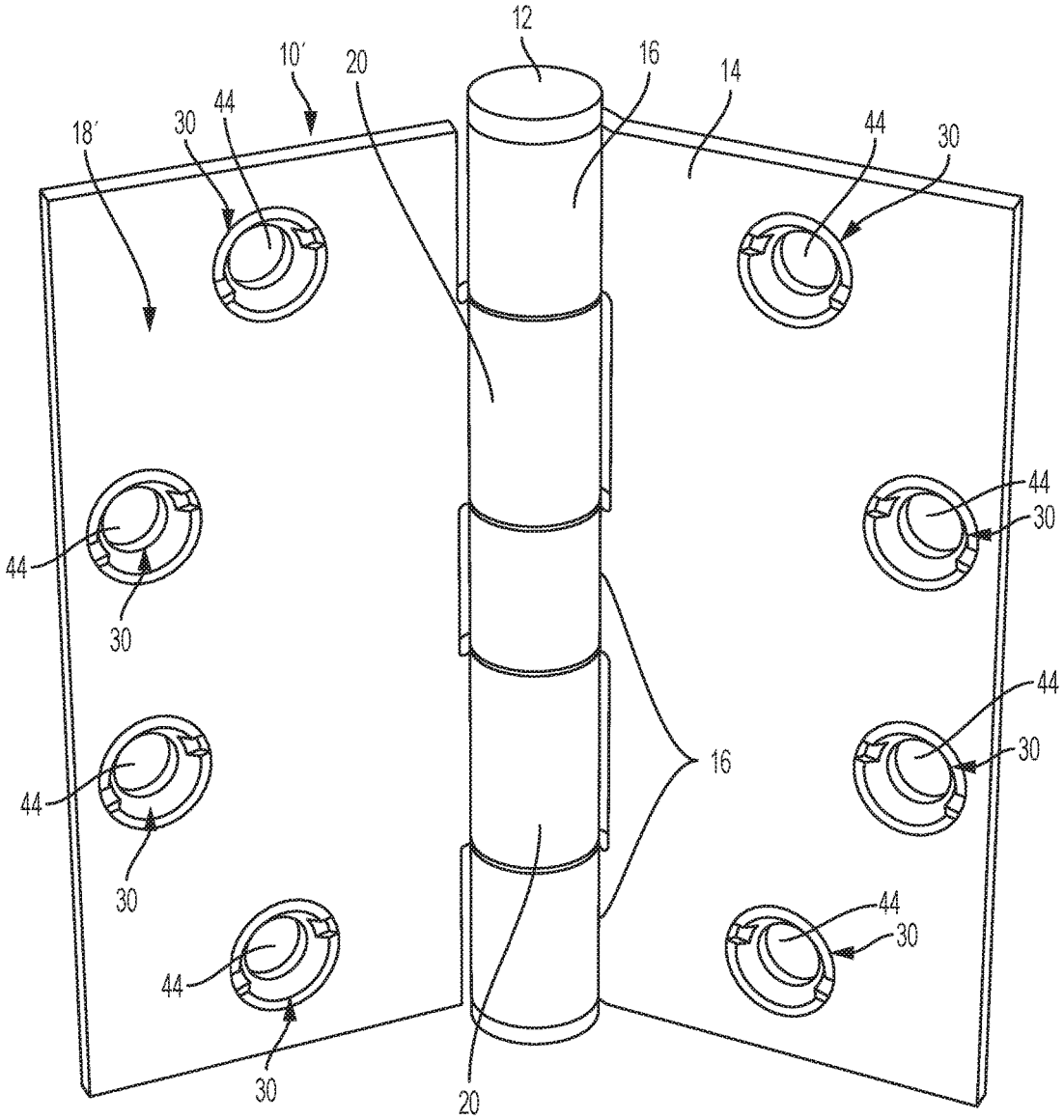
FIG. 2 is a front perspective view of another embodiment of an adjustable hinge according to the present invention.

An additional embodiment of the adjustable hinge 10' of the present invention is shown in FIG. 2, in which the conventional chamfered through-holes 24 formed in the door hinge plate 18 of FIG. 1 have been replaced by threaded apertures 22 formed in the door hinge plate 18'. Now, if desired, the adjustable hinge 10' of the present invention can be utilized in conjunction with a door 40, as well as a door frame 38. In that event, the same adjusters 30 used in the frame hinge plate 14 may be threadedly engaged with the door hinge plate 18', and the same method of the present invention for adjusting the gap 84 between the frame hinge plate 14 and the surface 83 of the frame 38, as was described above with reference to FIGS. 3 and 5A-5D, may be used to adjust the gap between the door hinge plate 18 and a surface of the door 40.

Figure 7A:
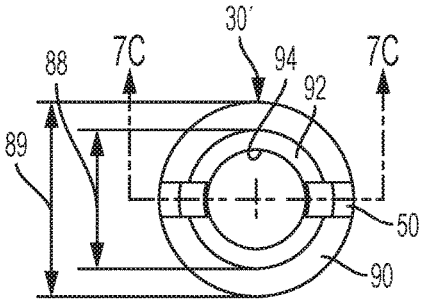
FIGS. 7A and 7B are top plan and side elevational detail views, respectively, of an adjuster of the adjustable hinge of FIG. 2.
Figure 7B:
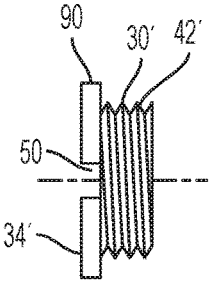
Figure 7D:
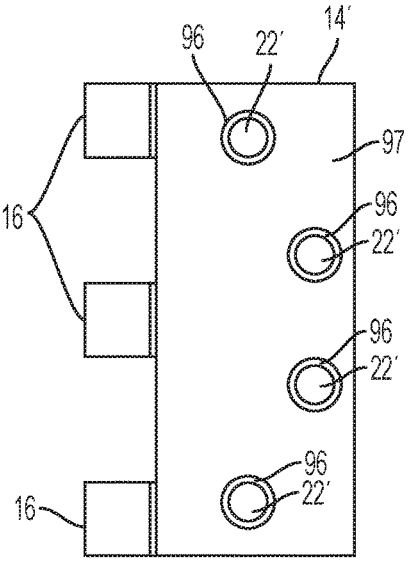
FIG. 7D is a top plan detail view of a frame hinge plate of the adjustable hinge FIG. 2, illustrating the shallow annular recesses formed around the threaded apertures for accepting the annular shoulders of the adjuster of FIG. 2
Figure 7C:
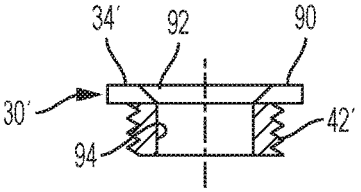
FIG. 7C is an elevational sectional detail view taken along lines 7C-7C of FIG. 7A.
Figure 8A:
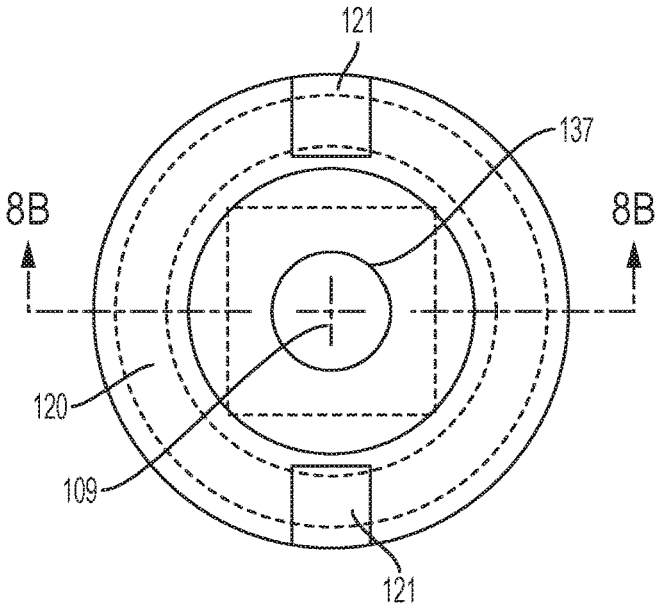
FIGS. 8A and 8C are top and bottom plan views, respectively, of a detail of a multi-part adjuster of another embodiment of an adjustable hinge according to the present invention.
Figure 8B:
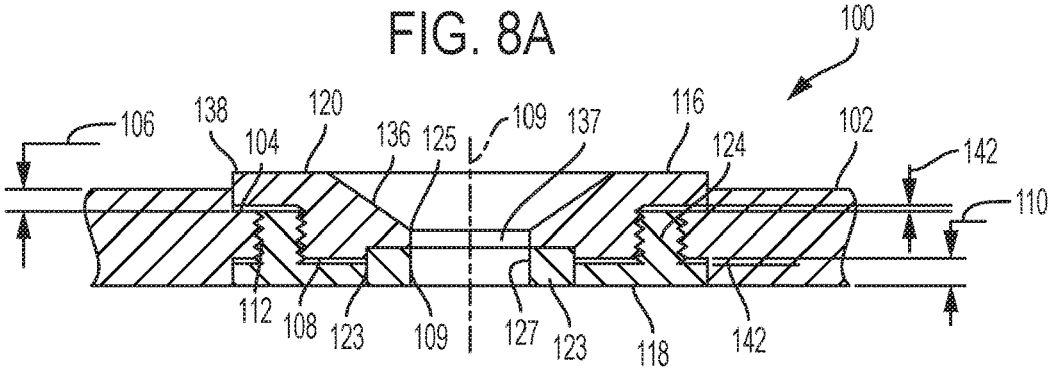
FIG. 8B is an elevational sectional detail view of the adjustable hinge of the present invention using the adjusters of FIGS. 8A and 8A, the section being taken along lines 8B-8B of FIG. 8A.
Figure 8C:
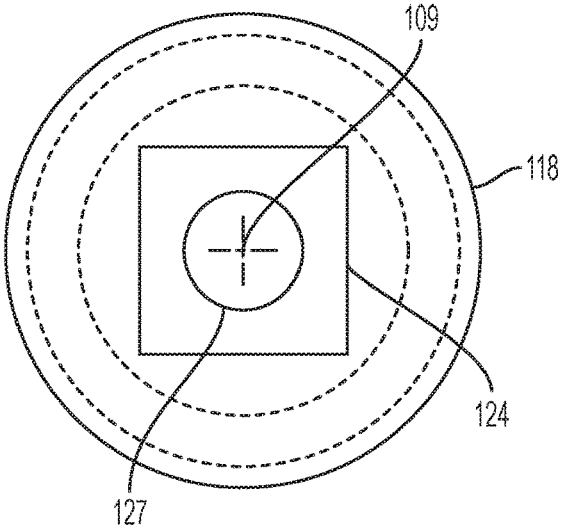

FIGS. 4 and 7A-7C illustrate another embodiment of the adjustable hinge 10, 10' of the present invention. If desired, adjustable hinge 10, 10' may include an adjuster 30' which has been modified for additional strength to define an annular shoulder 90, as shown in FIGS. 7A-7C. The annular shoulder 90 has an inner diameter 88 and an outer diameter 89, and defines a front face 34' of the adjuster 30'. The adjuster 30' defines a cylindrical pass-through bore 94 and a threaded annular outer surface 42' which is threadedly engageable with a threaded aperture 22' formed in a frame hinge plate 14'. The frame hinge plate 14' further defines an annular recess 96 disposed concentrically with the threaded aperture 22' in a front face 97 of the frame hinge plate 14', the annular recess 96 being configured to receive the annular shoulder 90. The adjuster 30' shown in FIGS. 7A-7C may be so dimensioned that the outer diameter 89 of the shoulder 90 may be 0.625" and the inner diameter 88 may be 0.450", a chamfer 92 may be formed at an 82° angle, and the pass-through bore 94 may have a diameter of 0.325". Furthermore, the height of the threaded outer annular surface 42' may be 0.125", the threads of which being ½-20, which again correspond to the threads of the threaded aperture 22. Of course, as previously noted, it should be understood that these dimensions are purely illustrative; the adjuster 30' and the frame hinge plate 14' may be configured in any way desired for a particular application to various embodiments of the adjustable hinge of the present invention.

So far, one-piece adjusters 10, 10' have been described for use with the adjustable hinges 10, 10' of the present invention. However, it may become desirable to construct the adjusters as multi-piece units, which may entail modifying the frame hinge plate 14.

Figure 9A:
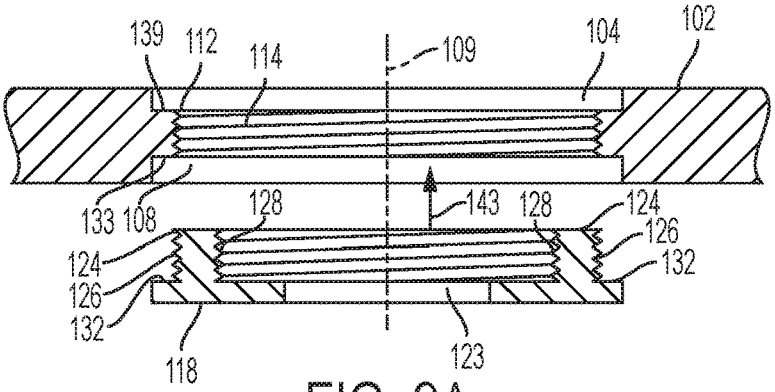
FIGS. 9A-9C are sequential elevational sectional detail views illustrating the method of assembling the multi-part adjuster and hinge plate of the adjustable hinge of the present invention shown in FIGS. 8A-8C.
Figure 9B:
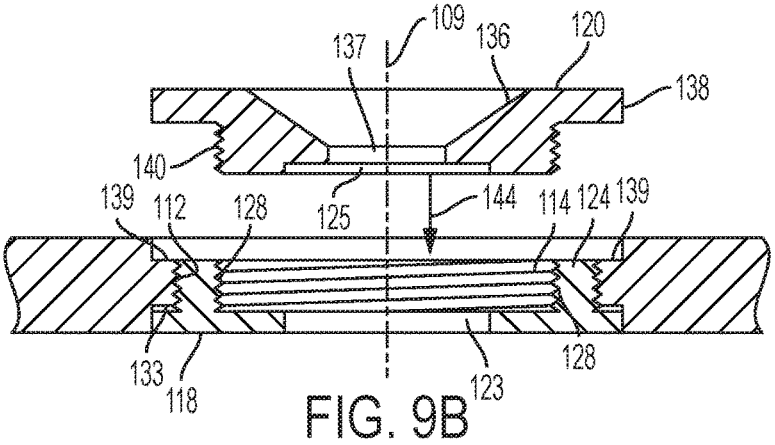

Referring to FIGS. 8A-8C and 9A-9C, an embodiment of an adjustable hinge 100 of the present invention incorporating such a multi-piece adjuster includes a frame hinge plate 102 defining a top annular recess 104 having a depth 106, and a bottom annular recess 108 having a depth 110, the bottom annular recess being coaxially aligned with the top annular recess along a longitudinal axis 109. The top annular recess 104 coacts with the bottom annular recess 108 to define a frame hinge plate threaded annular shoulder 112, the threads of which may be selected to be the same as the threads in the threaded apertures 22, 22'. As shown in FIGS. 9A and 9B, the hinge plate threaded annular shoulder 112 defines a threaded cavity 114. A multi-piece adjuster 116 according to the adjustable hinge 100 of the present invention includes a bottom bushing or first member 118 threadedly engageable with a top bushing or second member 120. The bottom bushing 118 and top bushing 120 define respective cavities 123, 125 coaxial with the longitudinal axis 109, each cavity defining a square cross-section. The bottom bushing 118 further defines an axially-extending cylindrical wall 124, which in turn defines outer exterior threads 126 and inner exterior threads 128. The outer exterior threads 126 are configured to threadedly engage the threaded shoulder 112 of the frame hinge plate 102. The bottom bushing 118 also defines an annular outer shoulder 132, which is configured to engage the frame hinge plate threaded shoulder 112, a bottom surface 133 of the threaded shoulder 112 acting as a hard stop limiting upward travel of the bottom bushing as it is threaded into the frame hinge plate 102.

Still referring to FIGS. 8A-8C and FIGS. 9A-9C, the top bushing 120 further defines two radially-opposed slots 121 (FIG. 8A) for engagement by the tangs 64, 78 of tools 52, 52', respectively. In addition, the top bushing 120 defines a chamfered through-bore 136 for accepting the head 56 of a fastener 54, and further includes an annular shoulder 138 configured to be accepted into the top annular recess 104 of the frame hinge plate 102. The top bushing 120 also defines a through-bore 137 disposed immediately below the chamfered through-bore 136, both of which bores 136, 137 being coaxial with the longitudinal axis 109. When the top and bottom bushings 120, 118 are threadedly connected together, they are configured to be advanced or retracted as a single unit or assembly within the frame hinge plate 102, such that the bottom bushing engages the surface of a frame or door to create the gap 84, as was previously described with respect to FIGS. 5A-5D. In this respect, a top surface 139 of the threaded shoulder 112 of the frame hinge plate 102 is configured to provide another hard stop to prevent the coupled upper and lower bushings 120, 118 from being advanced a greater distance out of the frame hinge plate 102 than 0.063", this distance being reflected in gap 142 (see, for example, FIG. 9C). Finally, the top bushing 120 defines a threaded cylindrical wall 140 adapted to be threadedly engaged with the inner exterior threads 128 of the bottom bushing cylindrical wall 124.

An anti-rotation member 122 having a square cross-section, and defining an annular through-bore 127 coaxial with longitudinal axis 109, engages the square cavities 123, 125 of the bottom and top bushings 118, 120, respectively, to ensure that no relative rotation occurs between the bottom and top bushings 118, 120 during the advancement or retraction of the coupled bushings. The diameter of a through-bore 127 of the anti-rotation member 122 is the same as the diameter of through-bore 137 defined by the top bushing 120; both through-bores 127 and 137 are configured to accept the fastener 54 during the process for creating a gap 84, as was described above with reference to FIGS. 5A-5D.

Figure 9C:
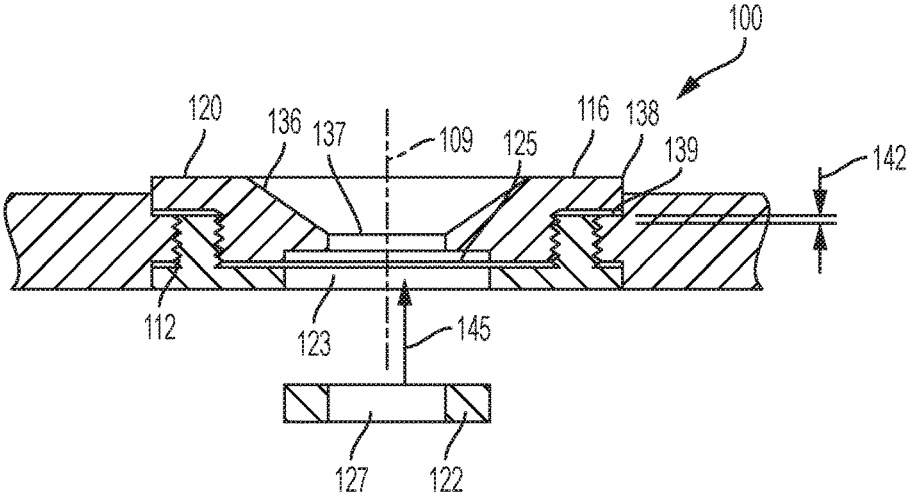

Referring now to FIGS. 9A-9C, the multi-piece adjuster 116 of the present invention is assembled by first inserting the lower bushing 118 into cavity 108 and threading it into engagement with the threaded shoulder 112 of the frame hinge plate 102, as shown by arrow 143 in FIG. 9A. Then the upper bushing 120 is inserted into cavity 104 and is threaded into engagement with the inner exterior threads 128 of the lower bushing 118, as shown by arrow 144 of FIG. 9B. To complete the assembly, the square anti-rotation member 122 is press-fit into mating cavities 123, 125 of the bottom and top bushings 118, 120, respectively, as shown by arrow 145 of FIG. 9C.

Figure 9D:
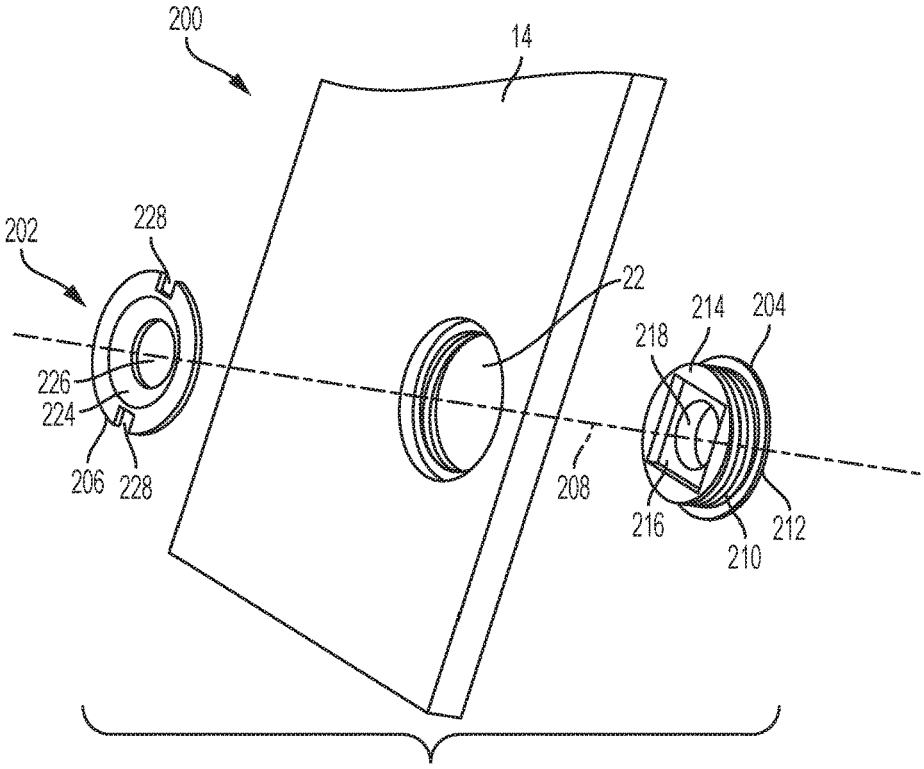
FIGS. 9D and 9E are exploded perspective detail views of another embodiment of a multi-part adjuster and hinge plate of the adjustable hinge of the present invention, and illustrate the use of a square anti-rotation member.
Figure 9E:
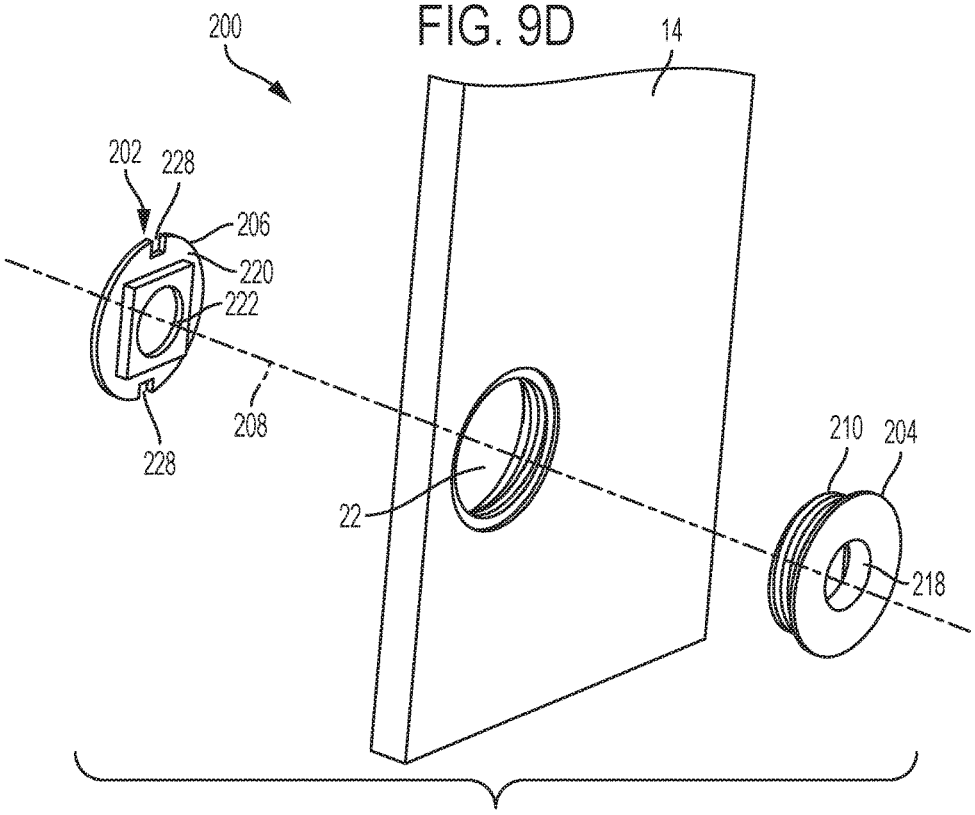
Figure 10A:
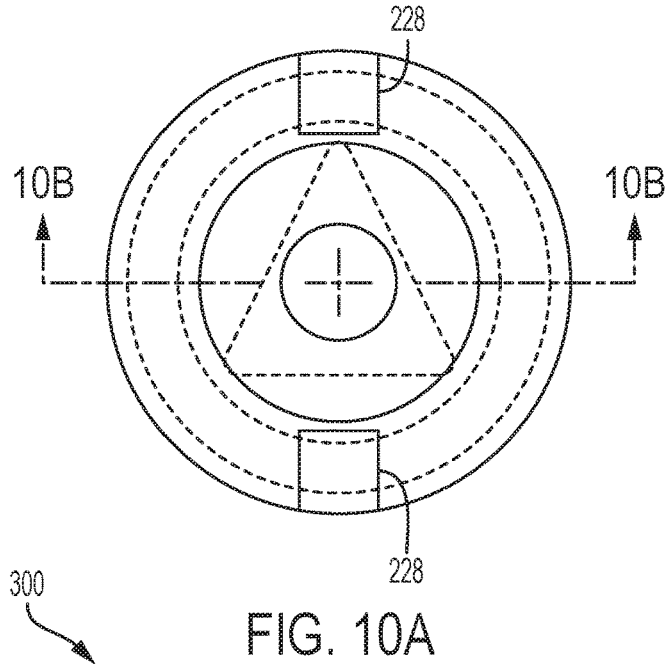
FIGS. 10A-10C are views similar to those of FIGS. 8A-8C, and illustrate the use of a triangular anti-rotation member of another embodiment of the adjustable hinge according to the present invention.
Figure 10B:
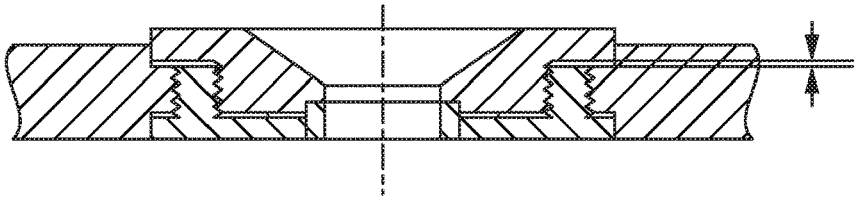
Figure 10C:
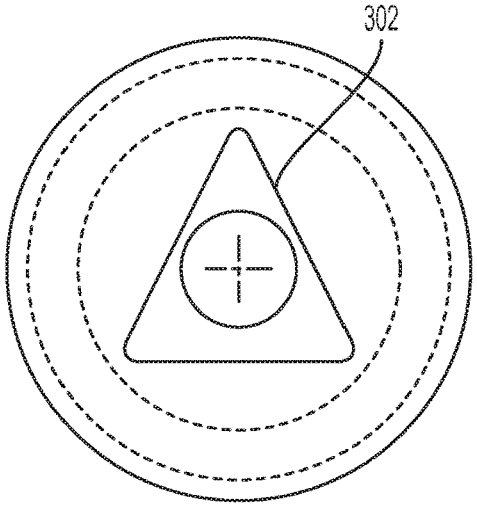
Figure 10D:
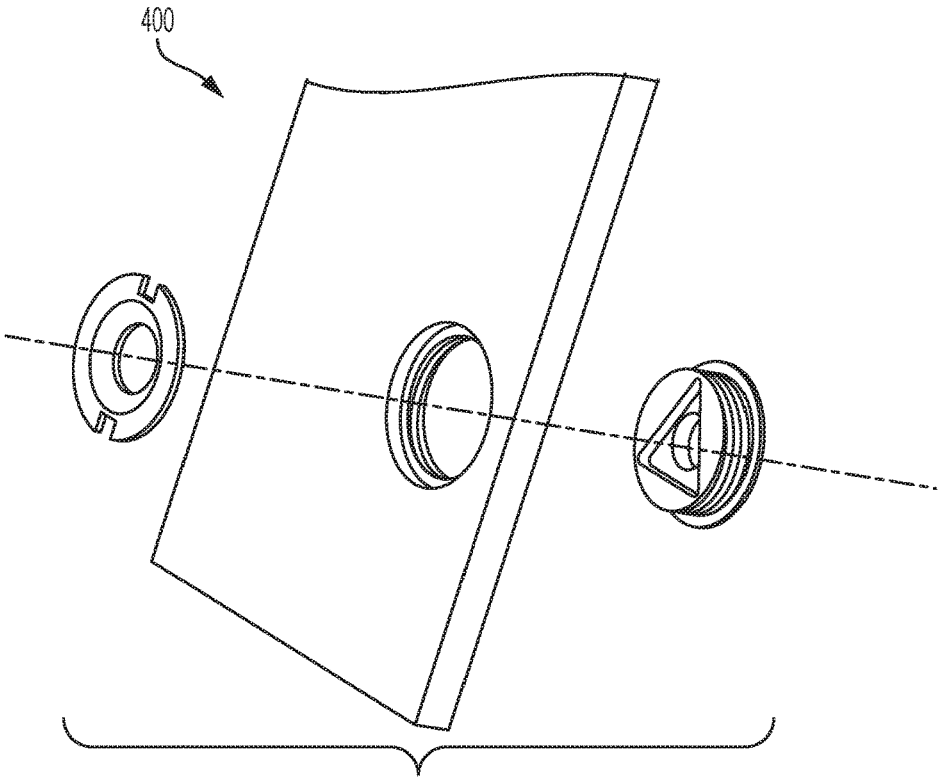
FIGS. 10D and 10E are exploded perspective detail views, similar to those of FIGS. 9D and 9E, of another embodiment of a multi-part adjuster and hinge plate of the adjustable hinge of the present invention, and illustrate the use of a triangular anti-rotation member.
Figure 10E:
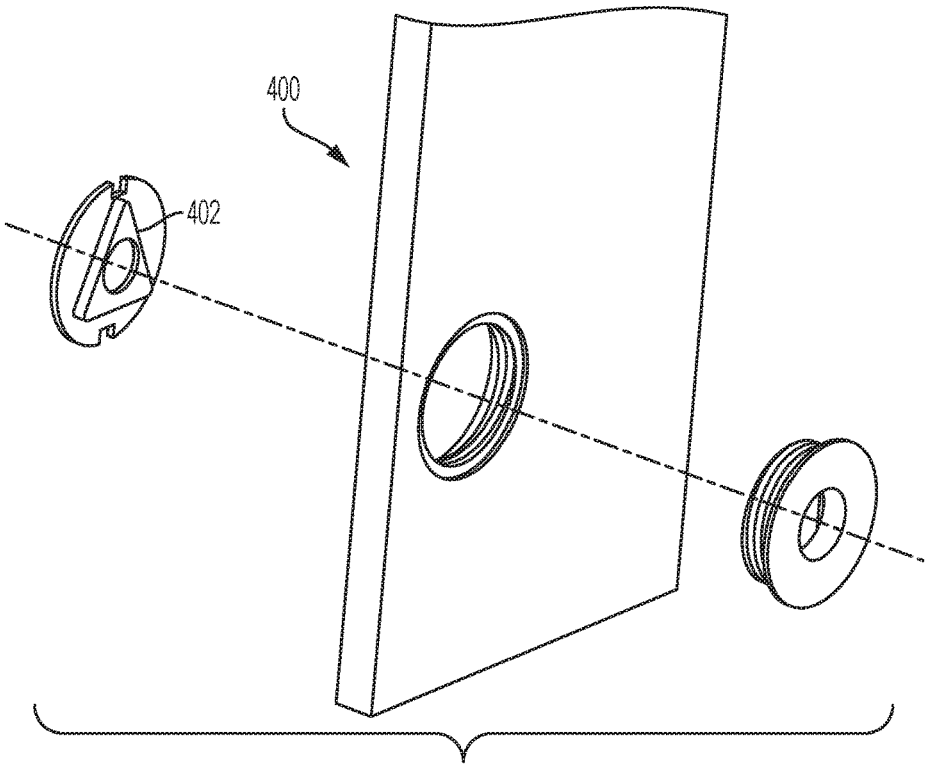

FIGS. 9D and 9E illustrate a simplified version of the multi-piece adjustable hinge of the present invention described above. An adjustable hinge 200 of the present invention includes an adjuster 202, which is composed of only two parts, namely, a bottom annular member 204 and a top annular member 206, which are coaxially aligned with a threaded aperture 22 of a frame hinge plate 14, along a longitudinal axis 208. The bottom annular member 204 includes a threaded cylindrical wall 210, which is configured to threadedly engage the threaded aperture 22 of frame hinge plate 14. The bottom annular member 204 further includes an annular shoulder 212 and a face 214, in which is formed a recess 216 having a square cross-section. A through-bore 218 coaxial with the longitudinal axis 208 is configured to accept a fastener 54 in a fashion similar to that shown in FIGS. 3 and 5A-5D.

Still referring to FIGS. 9D and 9E, the top annular member 206 includes an annular shoulder 220 and an anti-rotation member 222 having a square cross-section, the anti-rotation member 222 being configured to mate with the square recess 216 of the bottom member 204 with a press-fit. The top annular member 206 further defines an annular chamfer 224 configured to accept the head 56 of a fastener 54, as well as an annular through-bore 226 configured to accept the fastener. Finally, the top annular member defines two radially-opposed slots 228 configured to be engaged by the tangs 64, 78 of tools 52, 52', respectively. The anti-rotation member 222, the chamfer 224 and the through-bore 226 are coaxial with the longitudinal axis 208.

The adjuster 202 of this embodiment of an adjustable hinge 200 of the present invention is assembled by first threading the bottom annular member 204 into the threaded aperture 22 of the frame hinge plate 14. Then the top annular member 206 is oriented with the bottom annular member 204, such that the anti-rotation member 222 is aligned with its mating recess 216, and the bottom and top annular members 204, 206, are pressed together, creating an adjuster assembly 202 around the frame hinge plate 14. This adjuster assembly 202 can then be threaded in and out of the frame hinge plate 14, and is configured to use the coaction of the respective shoulders 212, 220 of the bottom and top annular members 204, 206, respectively, with the hinge plate 14 as hard stops, similar to the hard stops described with respect to the three-piece embodiment of the adjustable hinge 100 of the present invention described above.

Figure 11A:
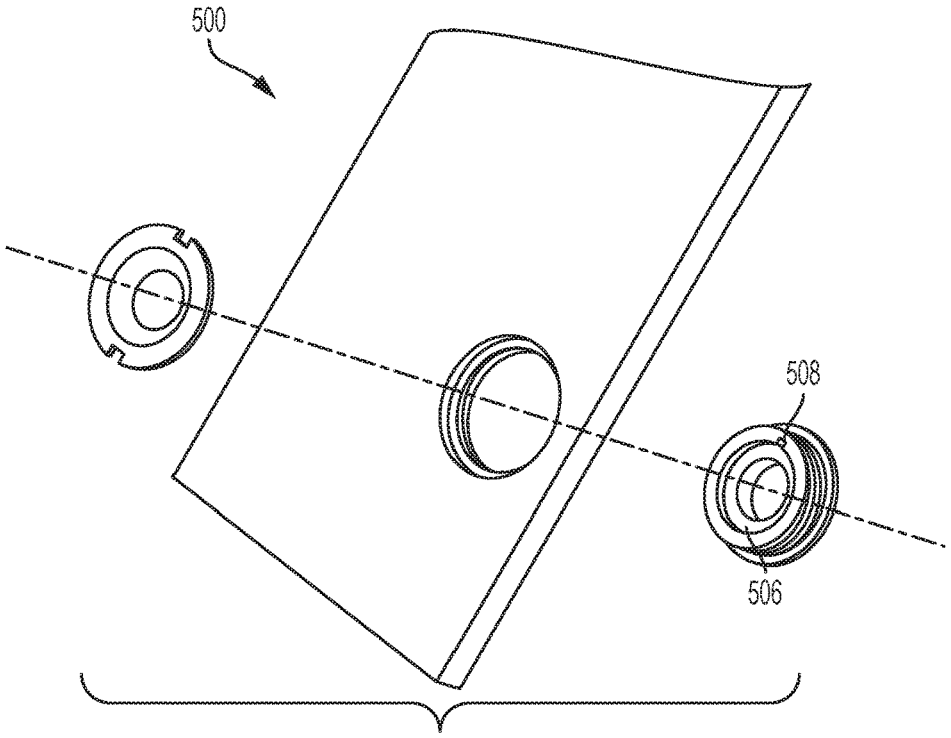
FIGS. 11A and 11B are exploded perspective detail views, similar to those of FIGS. 9D and 9E, of another embodiment of a multi-part adjuster and hinge plate of the adjustable hinge of the present invention, and illustrate the use of a circular anti-rotation member.
Figure 11B:
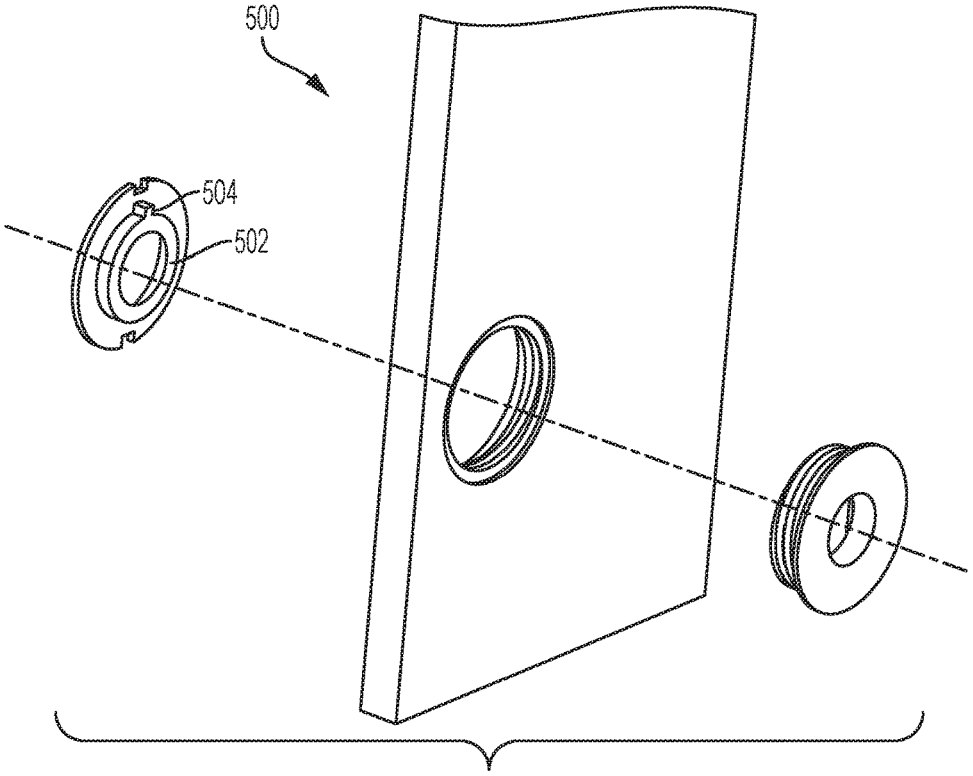
Figure 12A:
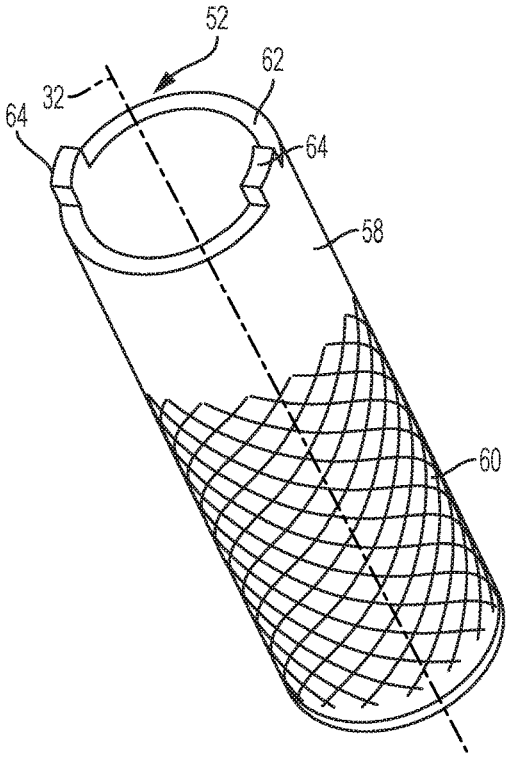
FIG. 12A is a perspective detail view of an adjuster-engaging tool for an embodiment of an adjustable hinge of the present invention.
Figure 12B:
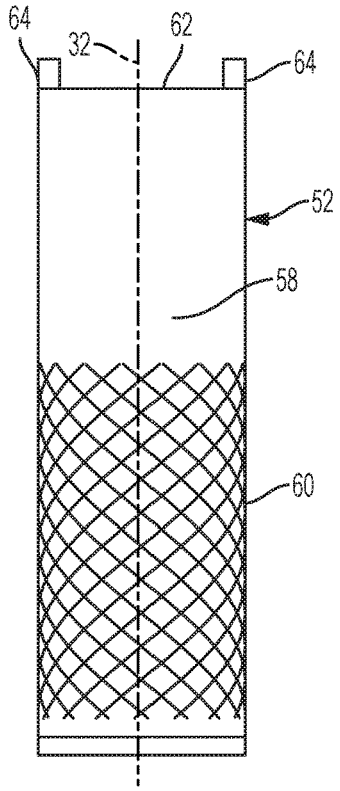
FIG. 12B is a front elevational detail view of the tool shown in FIG. 12A.
Figure 12C:
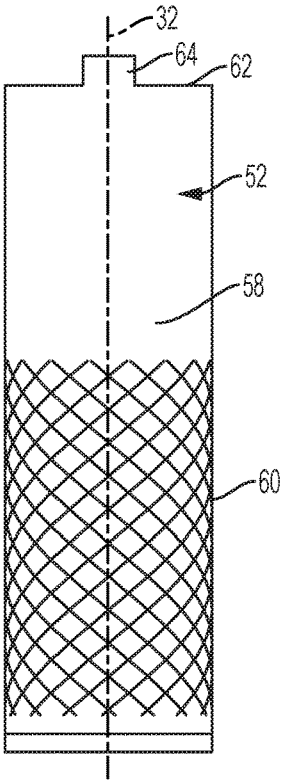
FIG. 12C is a side elevational detail view of the tool shown in FIG. 12A.
Figure 12D:
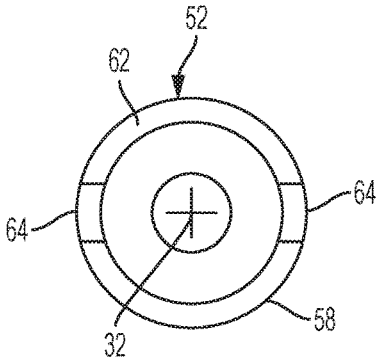
FIG. 12D is a top plan view of the tool shown in FIG. 12A.
Figure 13A:
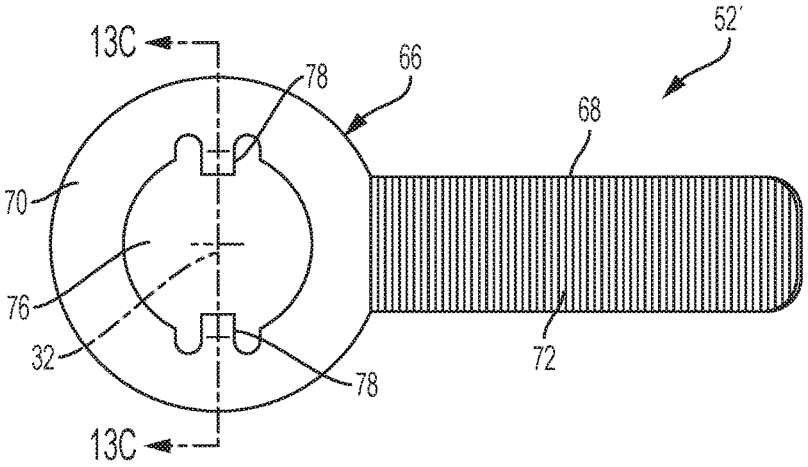
FIG. 13A is a top plan view of another embodiment of an adjuster-engaging tool for an adjustable hinge of the present invention.
Figure 13B:
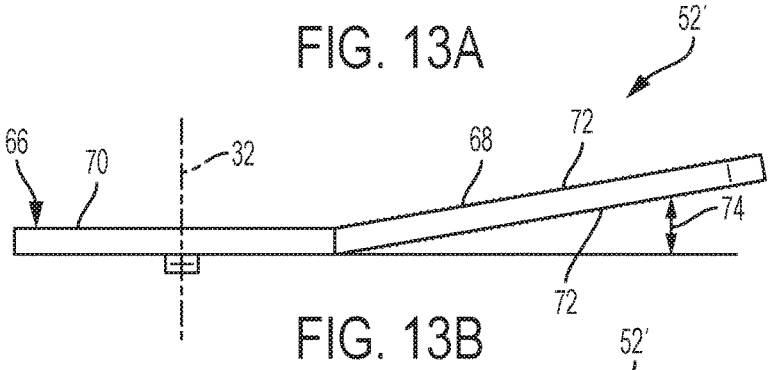
FIG. 13B is a side elevational view of the tool shown in FIG. 13A.
Figure 13C:
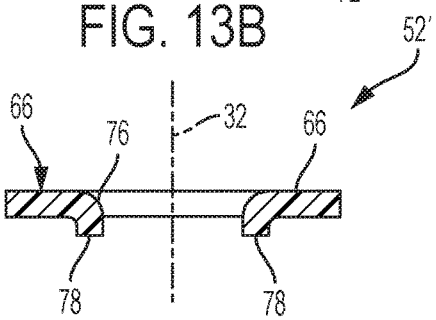
FIG. 13C is an elevational sectional view taken along lines 13C-13C of FIG. 13A.
Figure 13D:
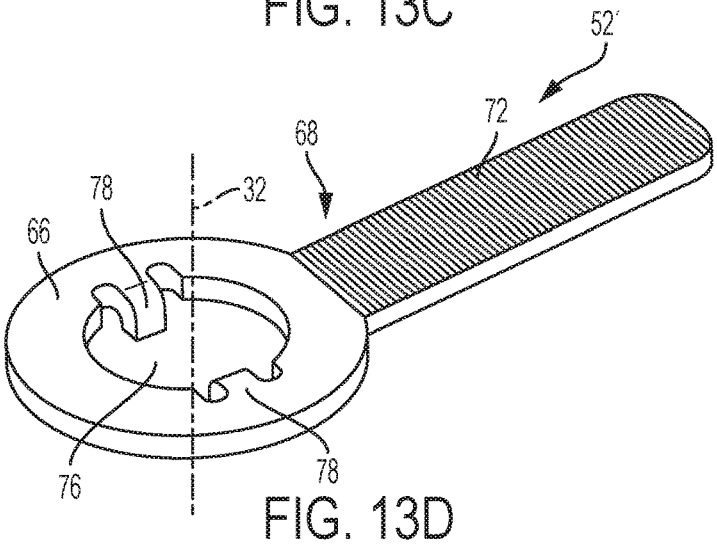
FIG. 13D is a perspective view of the tool shown in FIG. 13A.

The anti-rotation member 222 is not limited to having a square cross-section. For example, FIGS. 10A-10C, and FIGS. 10D and 10E illustrate adjustable hinges 300, 400 of the present invention, which are identical to adjustable hinges 100 and 200 of the present invention, except for the use of an anti-rotation member 302, 402 having a triangular cross-section. Furthermore, as illustrated in FIGS. 11A and 11B, which are similar to FIGS. 9D and 9E, respectively, an adjustable hinge 500 of the present invention includes an anti-rotation member 502 having a circular cross-section and may include a square orienting feature 504. The circular anti-rotation member 502 is press-fit into a circular recess 506 with the square orienting feature 504 engaging a square recess 508, similar to the assembly process described above with respect to the adjustable hinge assembly 200 of the present invention.

Although the adjustable hinges of the present invention have been described primarily in connection with a frame hinge plate, it should be understood that the present invention is similarly usable in conjunction with a door hinge plate.

It can now be seen that the present invention encompasses a door system including a door pivotably connected to a door frame via a plurality of adjustable hinges, according to various embodiments of the present invention, resulting in a significant cumulative reduction in time required to adjust the hinges of the door system.

While the present invention has been described with respect to various embodiments, the present invention may be further modified within the spirit and scope of this disclosure. This application is therefore intended to cover any variations, uses, or adaptations of the present invention using its general principles. Further, this application is intended to cover such departures from the present disclosure as come within known or customary practice in the art to which this invention pertains and which fall within the limitations of the appended claims.

What is claimed is:

1. A hinge, comprising:

a hinge pin;

a hinge plate coupled to the hinge pin;

the hinge plate defining a plurality of threaded apertures;

a plurality of adjusters configured to threadedly engage a respective one of the plurality of threaded apertures; and each of the plurality of adjusters defining a central pass-through bore for receiving a respective fastener configured to fasten the hinge plate to a door or a door frame, each adjuster includes an annular body defining a longitudinal axis, the pass-through bore having a first diameter and a second diameter, the second diameter being smaller than the first diameter and positioned between the first diameter and a rear face of the annular body, such that the pass-through bore forms a truncated cone.

2. The hinge claimed in claim 1, wherein:

the annular body further defining an annular rear face engageable with said door or door frame, and an annular front face;

the front face and the rear face lie in respective planes substantially perpendicular to the longitudinal axis; and wherein the pass-through bore being unthreaded.

3. The hinge claimed in claim 2, wherein each adjuster defines a tool-engaging feature configured for engagement by a tool for rotating the adjuster in its respective threaded aperture.

4. The hinge claimed in claim 3, wherein the tool-engaging feature is defined by two radially-opposed axial slots formed in each front face.

5. The hinge claimed in claim 2, wherein:

the annular body defining a first outer diameter;

the front face is defined by an annular shoulder having a second outer diameter greater than the first outer diameter;

the annular shoulder defining an internal chamfer;

the internal chamfer tapering radially inwardly to a cylindrical bore; and wherein the hinge plate defining a chamfer engageable by the annular shoulder.

6. The hinge claimed in claim 1, wherein:

the adjuster defining a longitudinal axis;

the hinge plate defining an annular shoulder proximate the threaded aperture;

the adjuster including first and second members defining respective bores coaxial with the longitudinal axis;

one of the first and second members including an outer surface configured to threadedly engage the hinge plate threaded aperture;

the first and second members being configured to be threadedly engageable with one another, so as to be advanced or retracted in the hinge plate threaded aperture as a single unit; and wherein at least one of the first and second members being configured to engage the hinge plate shoulder to limit the amount of axial travel of the first and second members in the hinge plate threaded aperture.

7. The hinge claimed in claim 6, further comprising an anti-rotation member coaxial with the longitudinal axis, and disposed within respective portions of the first and second members, for preventing relative rotation between the first and second members.

8. The hinge claimed in claim 1, wherein:

the adjuster including two annular members defining respective annular shoulders;

the annular members further defining respective pass-through bores coaxially aligned along a longitudinal axis;

one of the annular members including a threaded cylindrical wall threadedly engageable with the threaded aperture of the hinge plate;

the other of the annular members being connected to the one annular member so that the annular members may be advanced or retracted as a unit in the hinge plate threaded aperture, whereby the respective shoulders of the two annular members are configured to engage the hinge plate to limit the amount of travel that the adjuster can make within the hinge plate; and wherein one of the annular members defining an anti-rotation member and the other of the annular members defining a recess configured to accept the anti-rotation member.

9. The hinge claimed in claim 8, wherein the anti-rotation member has a cross-section which is any one of a rectangular, a triangular, and a circular cross-section.

10. The hinge claimed in claim 8, wherein the adjuster further defining a tool-engaging feature configured for engagement by a tool for rotating the adjuster in its respective threaded aperture.

11. The hinge claimed in claim 1, wherein:

the hinge plate defining a first hinge plate; and further comprising:

a second hinge plate coupled to the hinge pin; wherein the second hinge plate defining a plurality of apertures, each configured for receiving a fastener configured to fasten the second hinge plate to a door frame or door.

12. The hinge claimed in claim 11, wherein the plurality of apertures defined by the second hinge plate are threaded for receiving said adjusters.

13. The hinge claimed in claim 1, wherein the adjusters are operatively associated with the surface of the frame or door to change the distance between the hinge plate and the surface of the frame or door.

14. A door system, comprising:

a door pivotably connected to a door frame via a plurality of hinges;

the hinges including first and second hinge plates coupled to a hinge pin; wherein at least one of said first and second hinge plates defining a plurality of threaded apertures; and further comprising:

a plurality of annular threaded adjusters engaged with respective threaded apertures and configured to selectively axially bear against a surface of said door or door frame to change the distance between the at least one of said first and second hinge plates and a surface of the door or door frame; wherein, the adjusters further defining respective central pass-through bores for receiving a fastener; and further comprising:

a fastener disposed in each pass-through bore and configured to fasten said hinge plate to said door or door frame.

15. The door system claimed in claim 14, wherein:

each adjuster including an annular body defining a longitudinal axis;

the annular body further defining an annular rear face engageable with said door or door frame and an annular front face, the front and rear faces lying in planes substantially normal to the longitudinal axis; and wherein the pass-through bores being unthreaded, and having a first diameter proximate the front face and a second diameter proximate the rear face, the second diameter being smaller than the first diameter, such that the pass-through bore tapers radially inwardly towards the rear face.

16. The door system claimed in claim 15, wherein:

the adjuster further defining a longitudinal axis;

said at least one hinge plate defining an annular shoulder proximate the threaded aperture;

the adjuster including first and second members defining respective pass-through bores coaxial with the longitudinal axis;

one of the first and second members including an outer surface configured to threadedly engage the hinge plate threaded aperture;

the first and second members being configured to be threadedly engageable with one another, so as to be advanced or retracted in the hinge plate threaded aperture as a single unit; wherein at least one of the first and second members being configured to engage the hinge plate shoulder to limit the amount of axial travel of the first and second members in the hinge plate threaded aperture; and further comprising:

an anti-rotation member coaxial with the longitudinal axis, and operatively associated with the first and second members, for preventing relative rotation between the first and second members.

17. The door system claimed in claim 16, wherein:

the front face of the adjuster defining two radially-opposed tool-receiving slots axially formed in the front face; and further comprising:

a tool configured to engage the tool-receiving slots to rotate the adjuster in the threaded apertures.

18. The door system claimed in claim 17, wherein:

the tool including a cylindrical body defining a longitudinal axis and a through-bore coaxial with the longitudinal axis and being configured to slip over the fastener; and wherein the tool further defining two radially-opposed tangs axially extending from an end of the cylindrical body and engageable with said tool-receiving slots.

19. The door system claimed in claim 17, wherein:

the tool including an annular portion connected to a handle portion;

the annular portion defining and axis a central aperture configured to slip over said fastener; and wherein the aperture defining two radially-opposed axial tangs engageable with said tool-receiving slots.

20. The door system of claim 14, wherein the plurality of annular threaded adjusters are positionable relative to the hinge plate to axially bear against a surface of said door or door frame when engaged with respective threaded apertures, independent of the hinge plate.

21. A method of changing the spacing between a hinge plate mounted on a door or door frame, and the surface of the door or door frame, comprising:

loosening a fastener connecting the hinge plate to the door or door frame;

rotating an annular threaded adjuster disposed in a threaded aperture formed in the hinge plate about, and coaxial with, the fastener, so that the distance between a rear surface of the hinge plate and the surface of the door or door frame changes; and tightening the fastener.

22. The method claimed in claim 21, further comprising causing a tool to be engaged with the annular adjuster before loosening or tightening the fastener so that the adjuster is held stationary relative to the hinge plate.

* * * * *